US008992730B2

(12) United States Patent
Kida

(10) Patent No.: US 8,992,730 B2
(45) Date of Patent: Mar. 31, 2015

(54) METHOD AND APPARATUS FOR MANUFACTURING COATED PAPER

(71) Applicant: Japan Tobacco Inc., Tokyo (JP)

(72) Inventor: Shinzo Kida, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 14/256,256

(22) Filed: Apr. 18, 2014

(65) Prior Publication Data

US 2014/0224442 A1 Aug. 14, 2014

Related U.S. Application Data

(63) Continuation of application No. PCT/JP2012/056564, filed on Mar. 14, 2012.

(51) Int. Cl.

| | |
|---|---|
| ***D21F 11/00*** | (2006.01) |
| ***A24C 5/00*** | (2006.01) |
| ***A24D 1/02*** | (2006.01) |
| ***D21F 7/06*** | (2006.01) |
| ***D21H 19/10*** | (2006.01) |
| ***D21H 23/22*** | (2006.01) |
| ***D21H 27/00*** | (2006.01) |
| ***D21H 27/02*** | (2006.01) |
| ***D21H 27/26*** | (2006.01) |

(52) U.S. Cl.

CPC ..... *D21H 19/10* (2013.01); *A24C 5/005* (2013.01); *A24D 1/025* (2013.01); *D21F 7/06* (2013.01); *D21H 23/22* (2013.01); *D21H 27/00* (2013.01); *D21H 27/02* (2013.01); *D21H 27/26* (2013.01)

USPC ..... 162/139

(58) Field of Classification Search

USPC ..... 162/139, 125, 308; 131/365

See application file for complete search history.

(56) References Cited

U.S. PATENT DOCUMENTS

| | | | |
|---|---|---|---|
| 5,474,095 | A | 12/1995 | Allen et al. |
| 6,020,969 | A | 2/2000 | Struckhoff et al. |
| 6,198,537 | B1 | 3/2001 | Bokelman et al. |
| 2010/0297351 | A1 | 11/2010 | Kida et al. |
| 2012/0090799 | A1 | 4/2012 | Kida et al. |

(Continued)

FOREIGN PATENT DOCUMENTS

| | | | |
|---|---|---|---|
| JP | 4-289298 | A | 10/1992 |
| JP | 2001-509366 | A | 7/2001 |

(Continued)

OTHER PUBLICATIONS

International Search Report issued in PCT/JP2012/056564, mailed on Jun. 19, 2012.

(Continued)

*Primary Examiner* — Mark Halpern

(74) *Attorney, Agent, or Firm* — Birch, Stewart, Kolasch & Birch, LLP

(57) ABSTRACT

A method of manufacturing coated paper by applying a coating liquid to a strip-shaped web of paper to form a plurality of bands extending in the width direction of the web and spaced from each other in the longitudinal direction of the web includes: a coating step (S1) of applying the coating liquid to the web to form the bands with a coating band pitch narrower than a design band pitch defined as a standard for the coated paper; an aftertreatment step (S2), executed after the coating step, of drying the web; and a tension applying step (S3), executed after the aftertreatment step, of expanding the band pitch of the web by applying tension to the web to cause the band pitch of the web to approach the design band pitch.

12 Claims, 5 Drawing Sheets

(56) References Cited

U.S. PATENT DOCUMENTS

2012/0328772 A1* 12/2012 Kida et al. ..... 427/8
2013/0011546 A1 1/2013 Izumiya et al.

FOREIGN PATENT DOCUMENTS

JP 2009-148759 A 7/2009
WO WO 2009/099011 A1 8/2009
WO WO 2011/004460 A1 1/2011
WO WO 2011/117998 A1 9/2011

OTHER PUBLICATIONS

Written Opinion issued in PCT/JP2012/056564, mailed on Jun. 19, 2012.

* cited by examiner

METHOD AND APPARATUS FOR MANUFACTURING COATED PAPER

CROSS REFERENCE TO RELATED APPLICATIONS

This application is a Bypass Continuation of PCT International Application No. PCT/JP2012/056564 filed on Mar. 14, 2012, which is hereby expressly incorporated by reference into the present application.

TECHNICAL FIELD

The present invention relates to a method and apparatus for manufacturing coated paper by applying a liquid to a strip-shaped web of paper to form bands on the web.

BACKGROUND ART

One example of such coated paper is low ignition propensity wrapping paper for cigarettes.

In recent years, low ignition propensity wrapping paper for cigarettes has come to be widely known, and such wrapping paper has a fire retardant coated on (applied to) predetermined regions thereof. Where a cigarette using the low ignition propensity wrapping paper is lit, spread of fire toward the proximal or mouth end of the cigarette is restrained. Specifically, the low ignition propensity wrapping paper for cigarettes is obtained by applying a fire retardant in liquid form to a strip-shaped web of paper in such a manner that the regions applied with the fire retardant are spaced at predetermined intervals from each other in the longitudinal direction of the web and extend in the width direction of the web (like bands), and then subjecting the web to aftertreatment such as drying.

The low ignition propensity wrapping paper is often required to have bands of the fire retardant arranged at the intervals defined as a standard (hereinafter referred to as design band pitch). For example, where cigarettes to be produced require that the low ignition propensity wrapping paper to be used should have bands complying with the design band pitch, low ignition propensity wrapping paper having bands with an irregular band pitch or in disagreement with the design band pitch is rejected and is not used.

There has been known an apparatus which is configured to inspect the width and spacing of the bands of a fire retardant on the web in the process of manufacture of cigarette wrapping paper (Patent Document 1). Also, a cigarette paper manufacturing machine has been known in which the width of bands formed on the web is inspected by an inspection apparatus to adjust the amount of the fire retardant to be applied to form the bands (Patent Document 2).

CITATION LIST

Patent Literature

Patent Document 1: PCT International Application-Japanese Translation No. 2001-509366

Patent Document 2: Unexamined Japanese Patent Publication No. 2009-148759

SUMMARY OF INVENTION

Technical Problem

In the process of manufacture of the low ignition propensity wrapping paper, however, after the coating liquid is applied to the web to form the bands, a predetermined process such as drying process as stated above (hereinafter referred to as aftertreatment) is performed on the web, so that the web shrinks during the subsequent process. Consequently, the lengthwise dimension of the strip-shaped web varies during the manufacturing process. Also, there are a variety of kinds of webs and fire retardants used for low ignition propensity wrapping paper, and the extent of shrinkage is affected by the kind of the web or fire retardant used.

Since shrinkage of the web occurs under the influence of various factors as stated above, it is difficult to obtain wrapping paper having bands complying with a certain design band pitch.

Neither of the aforementioned Patent Documents 1 and 2 makes mention of the problem of web shrinkage caused during manufacture and consequent difficulty in obtaining low ignition propensity wrapping paper having bands complying with a design band pitch.

The present invention was created in view of the above circumstances, and an object thereof is to provide a coated paper manufacturing method whereby, even if a web shrinks in process of manufacture, coated paper can finally be made to have bands with a band pitch equivalent to a design band pitch, and a coated paper manufacturing apparatus suited for carrying out the manufacturing method.

Solution to Problem

To achieve the above object, the present invention provides a method of manufacturing coated paper by applying a coating liquid to a strip-shaped web of paper to form a plurality of bands extending in a width direction of the web and spaced from each other in a longitudinal direction of the web, including:

a coating step of applying the coating liquid to the web to form the bands with a coating band pitch narrower than a design band pitch defined as a standard for the coated paper;

an aftertreatment step, executed after the coating step, of drying the web; and a tension applying step, executed after the aftertreatment step, of expanding a band pitch of the web by applying tension to the web to cause the band pitch of the web to approach the design band pitch.

The aftertreatment step may further include smoothing wrinkles in the web.

In the tension applying step, tension may be applied to the web by a winding device connected to a take-up reel for winding the web thereon.

The coated paper may be low ignition propensity wrapping paper for cigarettes, obtained by applying a fire retardant to the web in the coating step.

In the tension applying step, feedback control may be performed in such a manner that the band pitch of the web subjected to the aftertreatment step is detected, and based on a detection result, tension to be applied to the web is adjusted.

To achieve the above object, the present invention also provides an apparatus for manufacturing coated paper by applying a coating liquid to a strip-shaped web of paper to form a plurality of bands extending in a width direction of the web and spaced from each other in a longitudinal direction of the web, including:

a coater configured to apply the coating liquid to the web to form the bands with a coating band pitch narrower than a design band pitch defined as a standard for the coated paper;

an aftertreatment unit configured to dry the web applied with the coating liquid; and a tension applier configured to expand a band pitch of the web by applying tension to the web delivered from the aftertreatment unit.

The aftertreatment unit may further include a wrinkle smoothing device configured to smooth wrinkles in the web.

The coater may include a coating device having a gravure roller configured to apply the coating liquid, the gravure roller has an engraved coating region for applying the coating liquid and an unengraved non-coating region alternating with the coating region in a rotating direction of the gravure roller, and the coating band pitch determined by the coating region and the non-coating region is preferably made narrower than the design band pitch by reducing a dimension of the non-coating region.

The coated paper may include low ignition propensity wrapping paper for cigarettes, obtained by applying a fire retardant to the web.

The apparatus may further include: a pitch detector configured to detect the band pitch of the web delivered from the aftertreatment unit; and a controller configured to perform feedback control in such a manner that based on a detection result provided by the pitch detector, the controller determines a tension to be applied to the web by the tension applier.

Advantageous Effects of Invention

In the coated paper manufacturing method of the present invention, the coating liquid is applied to the web to form bands with the coating band pitch narrower than the design band pitch, and after the web is subjected to the subsequent aftertreatment step, the tension applying step of applying tension to the web is executed to cause the band pitch of the web to approach the design band pitch, whereby coated paper having bands with a band pitch equivalent to the design band pitch can be obtained.

The coated paper manufacturing apparatus of the present invention includes the tension applier configured to apply tension to the web which has been applied with the coating liquid to form bands with the coating band pitch narrower than the design band pitch defined as the standard for the coated paper and which has been subjected to the aftertreatment, and the controller configured to control the tension applier so that the band pitch of the web may approach the design band pitch defined as the standard for the coated paper, whereby coated paper having bands with a band pitch equivalent to the design band pitch can be manufactured by the apparatus.

DESCRIPTION OF EMBODIMENTS

Figure 1:
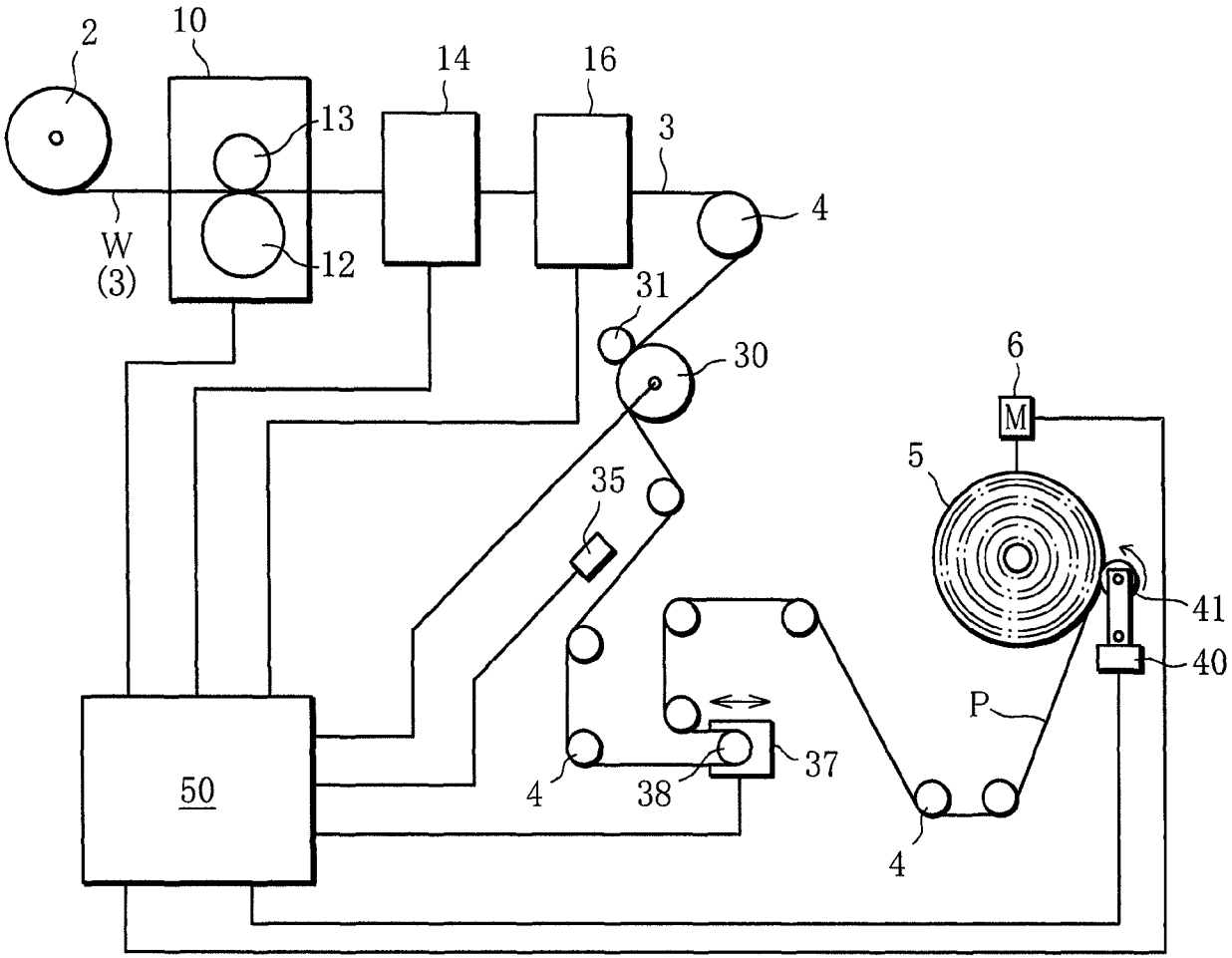
FIG. 1 illustrates an apparatus for manufacturing low ignition propensity wrapping paper, as a coated paper manufacturing apparatus according to a preferred embodiment of the present invention.

FIG. 1 illustrates an apparatus for manufacturing low ignition propensity wrapping paper, as a coated paper manufacturing apparatus according to a preferred embodiment of the present invention.

In the wrapping paper manufacturing apparatus 1 shown in FIG. 1, a web W, which is used to make wrapping paper for low ignition propensity cigarettes, is delivered from a supply reel 2 and is transported downstream along a travel path 3 while being subjected to various processes. A plurality of guide rollers 4, 4, . . . are arranged along the travel path 3, and low ignition propensity wrapping paper P, which is obtained by forming, on the strip-shaped web W of paper, bands of a fire retardant arranged in a longitudinal direction of the web W, is wound onto a take-up reel 5.

A coating device 10 is arranged on an upstream side of the travel path 3 and includes a gravure roller 12 and a pinch roller 13 so arranged as to hold the web W on the travel path 3 therebetween. When the web W passes between the gravure roller 12 and the pinch roller 13, the gravure roller 12 applies a fire retardant in liquid form, as a coating liquid, to one side, that is, one surface of the web W. The fire retardant is applied to the web W at predetermined intervals in a traveling direction of the web W.

Figure 2:
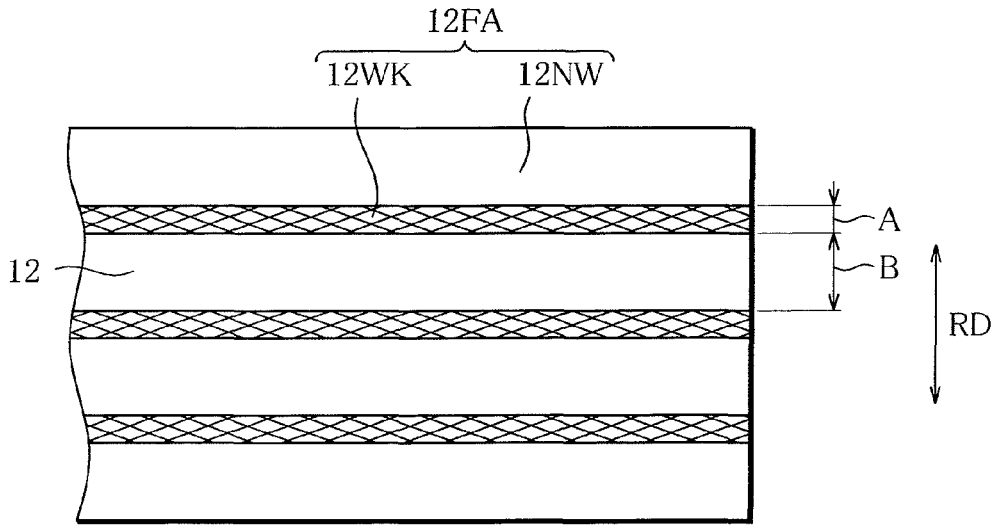
FIG. 2 is an enlarged view showing part of a surface of a gravure roller used in a coating device appearing in FIG. 1.

Specifically, as seen from the enlarged view of FIG. 2 showing part of the surface of the gravure roller 12, the gravure roller 12 has an uneven roller surface 12FA formed by engraving or the like such that band-like coating regions 12WK are arranged on the roller surface 12FA at regular intervals in a rotating direction RD of the gravure roller 12 to allow the fire retardant to be applied to the web.

More specifically, the coating region 12WK and unengraved smooth roller surface region (hereinafter referred to as non-coating region 12NW) are formed alternately on the gravure roller 12 as viewed in the rotating direction RD of the gravure roller 12. For example, each coating region 12WK has a circumferential dimension A, and each non-coating region 12NW has a circumferential dimension B. The sum (A+B) is referred to herein as the band pitch. FIG. 2 shows the band pitch of the gravure roller 12 (hereinafter referred to as coating band pitch).

Figure 3:
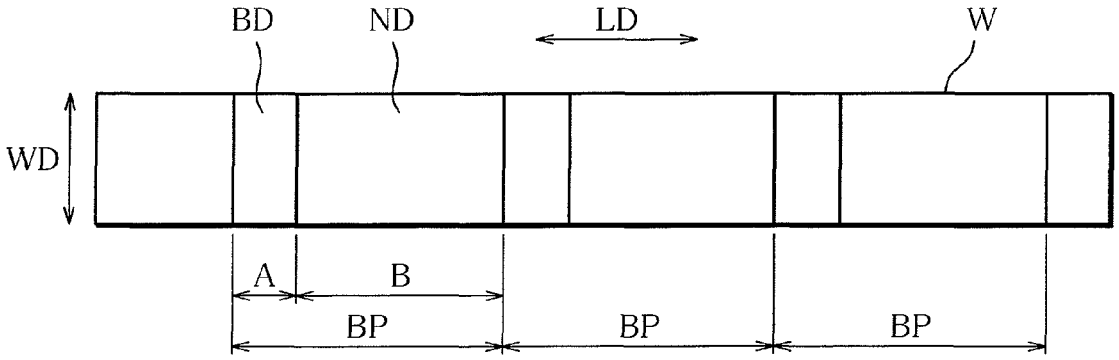
FIG. 3 illustrates a surface of a web applied with a fire retardant.

FIG. 3 illustrates the manner of how the fire retardant is applied to the surface of the web W. As shown in FIG. 3, a band portion BD applied with the fire retardant and an uncoated portion ND are alternately arranged on the web W. The band portions BD extend in a width direction WD of the web W over substantially the entire width of the web W and are spaced at predetermined intervals from each other (with a constant pitch) in the traveling direction LD of the web W. The web W travels in the same direction LD as, or parallel to, the rotating direction RD of the gravure roller 12.

In the web W shown in FIG. 3, the dimension A of each band portion BD and the dimension B of each uncoated portion ND, as measured in the traveling direction LD, correspond to the respective dimensions of the band pitch of the gravure roller 12 shown in FIG. 2.

Immediately after the application of the fire retardant, the band pitch BP is substantially identical with the coating band pitch of the gravure roller 12, but by the time the web is wound as the low ignition propensity wrapping paper P onto the take-up reel 5, the band pitch varies. This will be explained in detail later.

Referring again to FIG. 1, the explanation will be continued. A drying device 14 for drying the fire retardant applied to the web W is disposed in the travel path 3 at a location downstream of the coating device 10 so that the web W applied with the fire retardant may pass through the drying device 14. A plurality of hot air nozzles (not shown) are arranged inside the drying device 14 to eject hot air into the drying device 14. Consequently, while the web W passes through the drying device 14, the fire retardant applied to the web W, that is, the band portions BD, can be dried by the drying device 14. In the process of drying, the web W shrinks.

Further, a wrinkle smoothing device 16 is disposed in the travel path 3 at a location downstream of the drying device 14, and the web W passes through the wrinkle smoothing device 16 after being dried. The wrinkle smoothing device 16 to be used is not particularly limited and may be of any desired type insofar as it is capable of removing wrinkles in the web W. For example, the wrinkle smoothing device 16 may be a device which includes a water coating unit, not shown, and a heater roller (e.g. Yankee dryer), not shown, arranged downstream of the water coating unit and configured to rotate while applying tension and heat to the web W, and which is capable of smoothing out wrinkles in the web W. Where the web W is subjected to wrinkle smoothing after being dried in this manner, the web W elongates in the process of wrinkle smoothing. Thus, in cases where the aftertreatment includes wrinkle smoothing, the present invention can be more advantageously applied because there is an additional factor that causes change in design band pitch.

The web W, which is subjected to the aforementioned processes, is made of paper and has a basis weight of, for example, 20 to 70 g/m$^2$; therefore, the web W is liable to elongate and shrink as it is subjected to the processes while traveling along the travel path 3. Thus, even if the band pitch along the traveling direction of the web W is set to a predetermined pitch (e.g. design band pitch) at the time of coating, the band pitch of the web W varies thereafter. It is difficult to predict such variation in the band pitch, and the fact is that the band pitch of the low ignition propensity wrapping paper P (band pitch of the product) wound onto the take-up reel 5 is scarcely in agreement with the design band pitch.

The wrapping paper manufacturing apparatus 1 according to the present invention has a configuration described below so that the low ignition propensity wrapping paper P subjected to the aftertreatment may have a band pitch close to the design band pitch.

In the wrapping paper manufacturing apparatus 1, the coating device 10 (coater) applies the fire retardant to the web W to form the band portions with the coating band pitch narrower than the design band pitch, and a tension applier is provided to apply tension to the web W after the web W is subjected to the aftertreatment in the drying device 14 and the wrinkle smoothing device 16 (aftertreatment units) and before the web W is wound onto the take-up reel 5. A controller (monitoring system 50, described later) is configured to control the tension applier so that the band pitch of the web may become close to the design band pitch.

Referring now to FIGS. 2 and 3, where the coating band pitch BP is set to be narrower than the design band pitch, the dimension A of the coating region 12WK of the gravure roller 12, shown in FIG. 2, is preferably left unchanged (identical to that of the design band pitch), and the dimension B of the non-coating region 12NW is decreased. Thus, even though the band pitch BP for coating is reduced, the coating amount of the fire retardant applied to the web W remains the same, so that the fire retardant can maintain its function.

Preferably, the gravure roller 12 used in the coating device 10 has a coating band pitch shorter by 0.05 to 0.30 mm than the design band pitch, that is, the dimension B of the non-coating region 12NW is decreased by 0.05 to 0.30 mm. the coating band pitch is preferably shorter by about 0.15 mm than the design band pitch.

As shown in FIG. 1, a length measuring roller 30 is provided to measure a length of the web W that has passed by. The length measuring roller 30 is associated with a pinch roller 31 such that the web W is held between the length measuring roller 30 and the pinch roller 31, and the length measuring roller 30 makes a number of rotations corresponding to the length of the web W moved. A rotation detecting device such as a rotary encoder, not shown, is incorporated into the length measuring roller 30. Thus, the length measuring roller enables confirmation of an amount of travel (length) by which the web W has moved in a predetermined time (e.g., one second).

An output signal indicative of the amount of travel (length) of the web W, detected by the length measuring roller 30, is sent to the monitoring system 50 serving as the controller, described later.

A band sensor 35 is arranged downstream of the length measuring roller 30. The band sensor 35 to be used is not particularly limited and may be any desired detecting device insofar as it is capable of detecting the band portions BD of the moving web W. A suitable detecting device known in the art may be employed. For the band sensor 35, a detecting device may be used which includes, for example, a light emitter for radiating infrared light onto the moving web W and a light receiver for receiving the infrared light reflected from the web W. The reflected light received by the light receiver has different intensities depending on whether the infrared light has been reflected by the band portion BD applied with the fire retardant or by the uncoated portion ND. Thus, the band sensor 35 can distinguishably detect the band portion BD and the uncoated portion ND of the moving web W.

The band sensor 35 is configured to start operating in synchronism with the predetermined time for which the length measuring roller 30 measures the length of the web W. As explained above with reference to FIG. 3, the dimension of one pair of the band portion BD and the uncoated portion ND equals the band pitch BP. It is therefore possible to obtain the band pitch BP from the number of the pairs detected by the band sensor 35 and the amount of movement (length) of the web then measured by the length measuring roller 30. That is, the band pitch BP of the web W subjected to the aftertreatment can be ascertained on the downstream side of the coating device 10 before the web W is wound onto the take-up reel 5.

The output signal from the band sensor 35 is also sent to the monitoring system 50, and the above process of calculating the band pitch BP is executed by the monitoring system 50. The length measuring roller 30 and the band sensor 35 constitute a pitch detector.

A tension detecting device 37 for detecting the tension acting on the web W may be arranged downstream of the band sensor 35. The tension detecting device 37 may have a configuration in which a roller 38 in contact with the web W is urged by a spring member, not shown, in a predetermined direction (to the right in FIG. 1) with a constant pressure so that when a strong tension acts upon the web W, the roller 38 may move in the opposite direction (to the left) by a distance corresponding to the magnitude of the tension. Tension to be applied to the web W may be controlled by referring also to the tension detected by the tension detecting device 37.

The manufacturing apparatus 1 is equipped with a tension applier for increasing the tension of the web W as needed. The tension applier to be used is not particularly limited and may be any desired device insofar as it is capable of appropriately applying tension to the moving web W. For example, a motor 6 for winding the web onto the take-up reel 5 may be used as the tension applier. Specifically, the tension acting on the web W can be increased by increasing the winding tension applied by the motor 6 (increasing the take-up speed of the motor). When the web W is applied with such increased tension, its band pitch expands. Operation of the motor 6 (winding device) is controlled by the monitoring system 50.

Preferably, the manufacturing apparatus 1 is provided with a roll tightness adjusting device 40 for restraining variations in roll tightness of the web W (wrapping paper) wound onto the take-up reel 5. The roll tightness adjusting device 40 includes, as shown in FIG. 1 by way of example, a touch roller 41 for pressing, against the take-up reel 5, the web W being wound onto the take-up reel 5. The roll tightness adjusting device 40 increases or decreases the pressing force of the touch roller 41 in inverse proportion to the tension acting on the web W. For example, when the tension acting on the web W decreases, which may lead to lowering of the roll tightness and loosening of the web roll, the pressing force exerted by the touch roller 41 is increased, whereby decrease in the roll tightness of the product wound onto the take-up reel 5 is compensated. Operation of the roll tightness adjusting device 40 may also be controlled by the monitoring system 50.

The wrapping paper manufacturing apparatus 1 includes the monitoring system 50 as stated above. The monitoring system 50, which is, for example, a microcomputer for performing overall control of the manufacturing apparatus, controls the operations of the aforementioned devices including the coating device 10, the drying device 14 and the wrinkle smoothing device 16, and also functions as a controller for controlling the tension acting on the web so that the wrapping paper obtained may have bands with a band pitch equivalent to the design band pitch.

Figure 4:
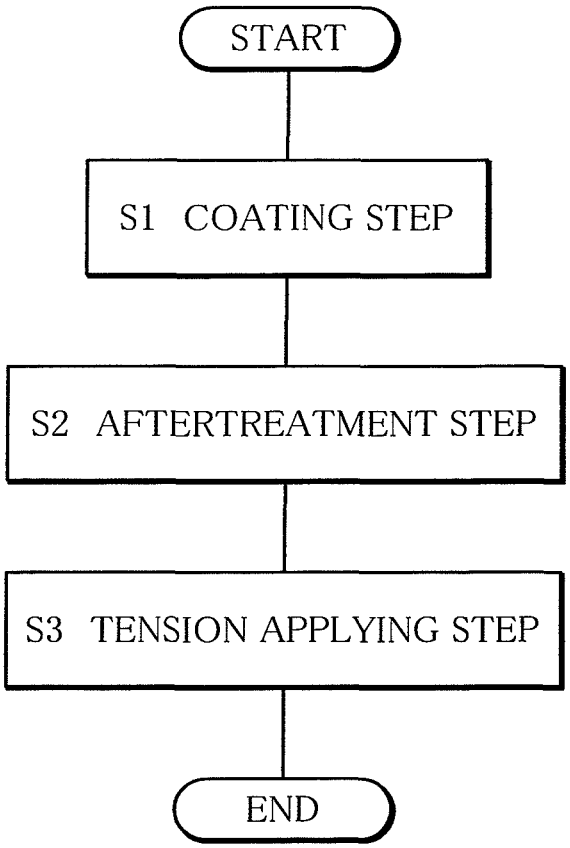
FIG. 4 is a flowchart illustrating basic control executed when a monitoring system functions as a controller.

FIG. 4 is a flowchart illustrating basic control executed when the monitoring system 50 functions as the controller. The basic control will be explained with reference to FIG. 4.

First, the monitoring system 50 executes a coating step (S1). In the coating step, the coating device 10 is operated. Specifically, in this step (S1), the fire retardant (coating liquid) is applied to the web W to form band portions BD (see FIGS. 2 and 3) with the coating band pitch narrower than the design band pitch, which is defined as a standard band pitch of low ignition propensity wrapping paper.

Subsequently, the monitoring system 50 executes an aftertreatment step (S2). That is to say, the aftertreatment, which includes the process of drying the web W by means of the drying device 14 and the process of smoothing wrinkles by means of the wrinkle smoothing device 16, is performed after the coating step (S2), to arrange the shape of the web W.

Then, the monitoring system 50 executes a tension applying step (S3). The tension applying step (S3) is a step executed after the aftertreatment step (S2) to expand the band pitch of the web W by applying tension to the web W so that the band pitch BP of the treated web W may become close to the target design band pitch. It is to be noted that the above explanation of the steps is directed to a certain portion of the web W which is sequentially subjected to different processes, and since in practice the web W is continuously treated, the aforementioned steps are concurrently executed for respective different portions of the web W.

Preferably, in the tension applying step (S3), feedback control is performed in such a manner that tension is applied to the web W while detecting the actual band pitch BP of the web W on the basis of the outputs from the length measuring roller 30 and the band sensor 35 (on the basis of the result of detection of the band pitch). Such feedback control enables the applied tension to be suited for the detected state of the web W, whereby the band pitch of the web W can be made to approach the design band pitch.

As described above, the coating band pitch is set to be narrower than the design band pitch, and then under the control of the monitoring system 50, tension is applied to the web W so that the bands of the web W may have a band pitch BP identical with or very close to the design band pitch before the web W, that is, the low ignition propensity wrapping paper, is wound onto the take-up reel 5.

Figure 5:
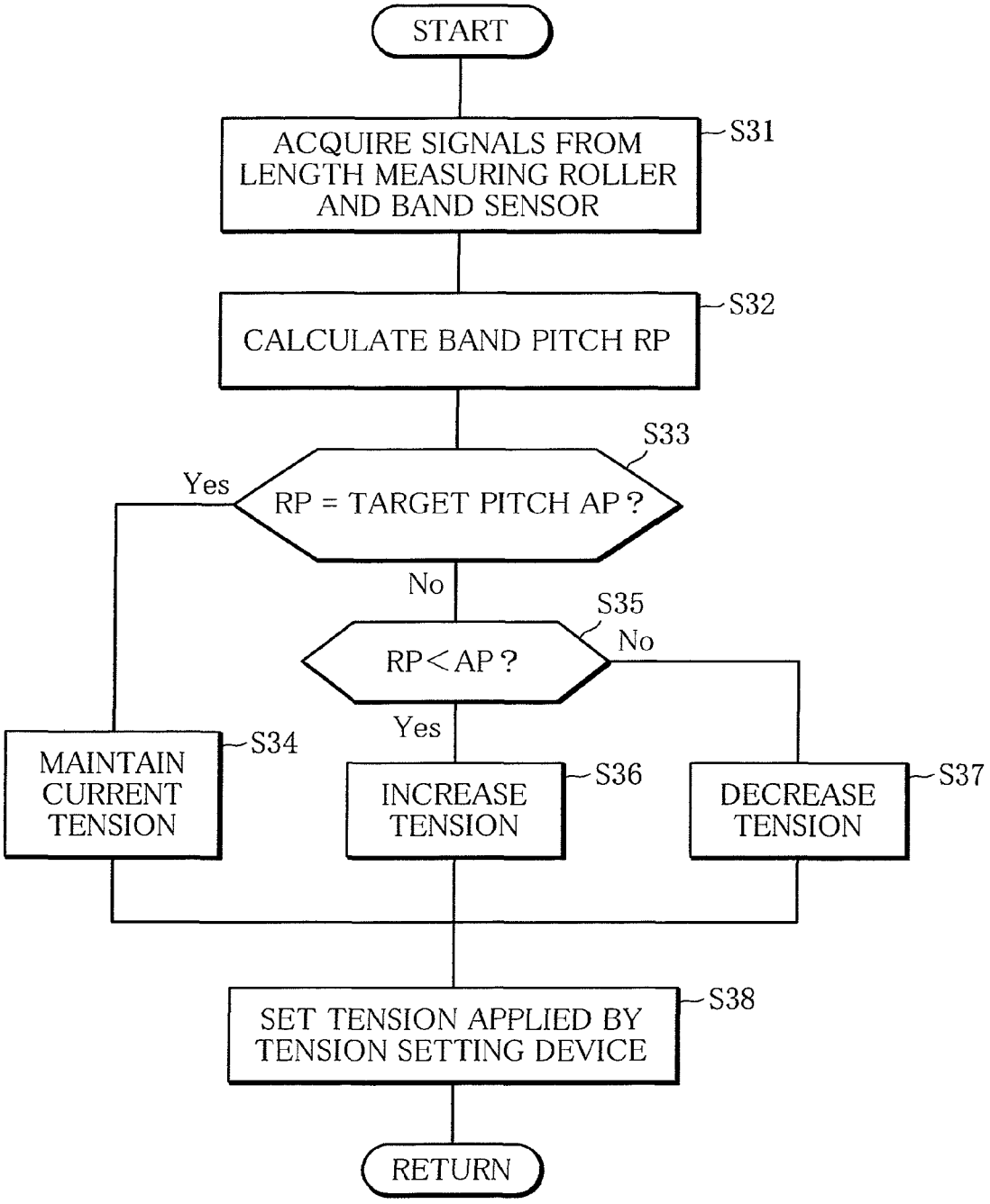
FIG. 5 is a flowchart illustrating an exemplary process executed in a tension applying step by the monitoring system.

FIG. 5 is a flowchart exemplifying a preferred control process executed in the tension applying step (S3) by the monitoring system 50.

The process illustrated in the flowchart is started at predetermined intervals of time. First, the monitoring system 50 acquires detection signals from the length measuring roller and the band sensor 35 constituting the pitch detector (S31), and calculates an actual band pitch RP of the web W (S32). The band pitch RP is compared with a design band pitch AP defined as the standard band pitch (S33). Based on the comparison result, the monitoring system 50 determines a tension to be applied to the web W.

If the band pitch RP of the web W is equal to the design band pitch AP, then it is unnecessary to adjust the tension; therefore, the monitoring system 50 judges that the current tension should be maintained (S34), and supplies a signal to a tension setting device to maintain the current tension (S38). Consequently, the tension setting device maintains the tension then applied to the web W. The tension setting device corresponds to the motor 6 for applying tension to the web W being wound onto the take-up reel 5, explained above with reference to FIG. 2.

If it is judged by the monitoring system 50 that the band pitch RP is smaller than the design band pitch AP (S35), the monitoring system 50 concludes that the tension should be increased (S36), and supplies a signal to the tension setting device to increase the tension (S38). In this case, the tension setting device increases the tension applied to the web W.

Conversely, if it is judged that the band pitch RP is greater than the design band pitch AP (S35), the monitoring system 50 concludes that the tension should be decreased (S37), and supplies a signal to the tension setting device to decrease the tension (S38). In this case, the tension setting device decreases the tension applied to the web W.

In the wrapping paper manufacturing apparatus 1 according to the present invention, the monitoring system 50 performs feedback control by repeatedly executing the process shown in the flowchart of FIG. 5, whereby the detected band pitch RP can be made to approach the design band pitch AP. It is therefore possible to manufacture such low ignition propensity wrapping paper that the pitch of the bands on the web W is identical with or very close to the design band pitch.

The wrapping paper manufacturing apparatus 1 shown in FIG. 1 is configured such that tension is applied to the web W by the motor 6 for driving the take-up reel 5, and thus the web W is applied with tension while being wound onto the take-up reel 5. The configuration of wrapping paper manufacturing apparatus to which the present invention is applicable is not limited to such configuration alone.

Figure 6:
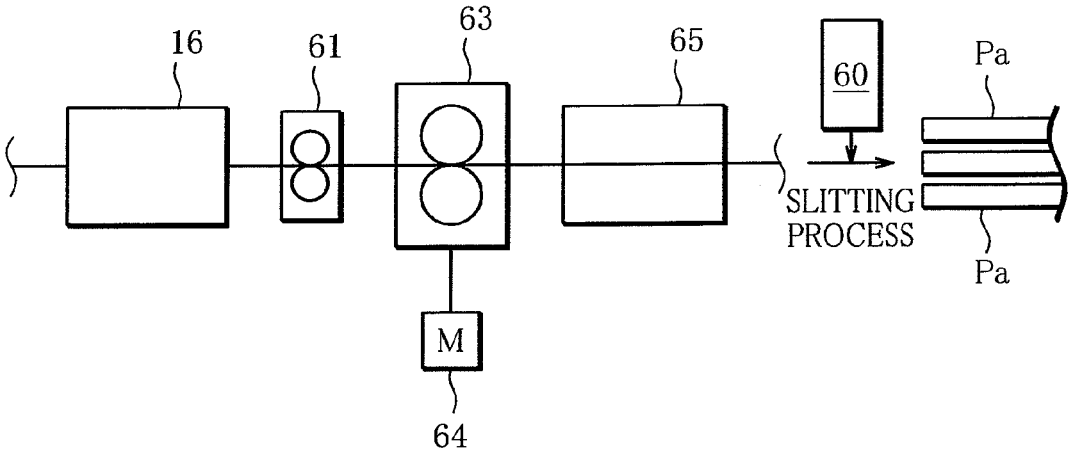
FIG. 6 illustrates a coated paper manufacturing apparatus according to a second preferred embodiment of the present invention, wherein illustration of elements and parts identical with those of the first embodiment is omitted.

FIG. 6 illustrates a modification of the wrapping paper manufacturing apparatus, wherein a slitting process for cutting the web W to a product width complying with a cigarette manufacturing apparatus is performed on the downstream side of the apparatus.

The configuration of the modification on the upstream side of the wrinkle smoothing device 16 is identical with that of the wrapping paper manufacturing apparatus 1 shown in FIG. 1, and the downstream side of the modification is configured differently. The difference will be explained below.

In FIG. 6, the web W delivered from the wrinkle smoothing device 16 is wound onto a take-up reel or the like for the cigarette manufacturing apparatus after being cut to the product width by a slitter device 60 arranged at a termination end of the travel path. In the illustrated modification, the web W is cut into three strips for the sake of simplicity of illustration; in practice, the web W is cut into approximately 100 to 20 strips. In the slitting process of the modification, the web is cut at two locations by the slitter device 60 into three strips Pa each being wrapping paper for cigarettes.

In the example illustrated in FIG. 6, a tension adjusting roller device 61, a tension applying roller device 63 and a band pitch detecting device 65 are arranged between the wrinkle smoothing device 16 and the slitter device 60 in the mentioned order from the upstream side. The tension adjusting roller device 61 and the tension applying roller device 63 each function as a tension cut-off roller capable of cutting off the tensile force (tension) acting on the web. In the illustrated example, the tension adjusting roller device and the tension applying roller device are each of a type using nip rollers to hold the web W therebetween but may be of a different type using a suction roller, for example.

The tension applying roller device 63 arranged downstream of the tension adjusting roller device 61 is associated, for example, with a motor 64 for applying tension to the web W as needed. Namely, the motor 64 performs the function of the aforementioned motor 6 associated with the take-up reel 5, and tension is applied to the web W by increasing the web feed speed of the tension applying roller device 63 relative to the web feed speed of the tension adjusting roller device 61. By varying the relative speed, it is possible to adjust the magnitude of the tension.

The band pitch detecting device 65 may be any desired device insofar as it is capable of detecting the band pitch. For example, the length measuring roller 30 and the band sensor 35 explained above may be used.

Like the foregoing embodiment, a monitoring system (not shown) may be configured to control the tension applying roller device 63 on the basis of the band pitch detected by the band pitch detecting device 65 so that the detected band pitch RP may approach the design band pitch AP. Thus, it is possible to manufacture such low ignition propensity wrapping paper that the pitch of the bands on the web W is identical with or very close to the design band pitch.

In FIG. 6, the band pitch detecting device 65 is arranged downstream of the tension applying roller device 63 but may alternatively be arranged upstream of the tension applying roller device 63.

The present invention is not limited to the foregoing embodiments and may be modified in various ways.

For example, in the above embodiment, the fire retardant is applied as a coating liquid to manufacture low ignition propensity wrapping paper, but the present invention is also applicable to manufacture of other types of coated paper obtained by applying a liquid to a web to form bands.

REFERENCE SIGNS LIST

1: wrapping paper manufacturing apparatus
2: supply reel
3: travel path
6: motor (winding device)
5: take-up reel
10: coating device (coater)
12: gravure roller
12WK: coating region
12NW: non-coating region
14: drying device (aftertreatment unit)
16: wrinkle smoothing device (aftertreatment unit)
30: length measuring roller (pitch detector)
35: band sensor (pitch detector)
37: tension detecting device
40: roll tightness adjusting device
50: monitoring system (controller)
100: cigarette manufacturing apparatus
W: web
P: low ignition propensity wrapping paper
BD: band portion
ND: uncoated portion
BP: band pitch

The invention claimed is:

1. A method of manufacturing coated paper by applying a coating liquid to a strip-shaped web of paper to form a plurality of bands extending in a width direction of the web and spaced from each other in a longitudinal direction of the web, comprising:

a coating step of applying the coating liquid to the web to form the bands with a coating band pitch narrower than a design band pitch defined as a standard for the coated paper;

an aftertreatment step, executed after the coating step, of drying the web and smoothing wrinkles in the web; and a tension applying step, executed after the aftertreatment step, of expanding a band pitch of the web by applying tension to the web to cause the band pitch of the web to approach the design band pitch, wherein, in said tension applying step, feedback control is performed in such a manner that the band pitch of the web subjected to the aftertreatment step is detected, and based on a detection result, tension to be applied to the web is adjusted.

2. The method according to claim 1, wherein, in the tension applying step, tension is applied to the web by a winding device connected to a take-up reel for winding the web thereon.

3. The method according to claim 2, wherein the coated paper is low ignition propensity wrapping paper for cigarettes, obtained by applying a fire retardant to the web in the coating step.

4. The method according to claim 1, wherein the coated paper is low ignition propensity wrapping paper for cigarettes, obtained by applying a fire retardant to the web in the coating step.

5. The method according to claim 1, wherein, in the tension applying step, tension is applied to the web by a winding device connected to a take-up reel for winding the web thereon.

6. The method according to claim 5, wherein the coated paper is low ignition propensity wrapping paper for cigarettes, obtained by applying a fire retardant to the web in the coating step.

7. An apparatus for manufacturing coated paper by applying a coating liquid to a strip-shaped web of paper to form a plurality of bands extending in a width direction of the web and spaced from each other in a longitudinal direction of the web, comprising:

a coater configured to apply the coating liquid to the web to form the bands with a coating band pitch narrower than a design band pitch defined as a standard for the coated paper;

an aftertreatment unit configured to dry the web applied with the coating liquid, wherein said aftertreatment unit also comprises a wrinkle smoothing device configured to smooth wrinkles in the web;

a pitch detector configured to detect the band pitch of the web delivered from the aftertreatment unit;

a controller configured to perform feedback control in such a manner that based on a detection result provided by the pitch detector, the controller determines a tension to be applied to the web by the tension applier; and a tension applier configured to expand a band pitch of the web by applying tension to the web delivered from the aftertreatment unit.

8. The apparatus according to claim 7, wherein:

the coater includes a coating device having a gravure roller configured to apply the coating liquid, the gravure roller has an engraved coating region for applying the coating liquid and an unengraved non-coating region alternating with the coating region in a rotating direction of the gravure roller, and the coating band pitch determined by the coating region and the non-coating region is made narrower than the design band pitch by reducing a dimension of the non-coating region.

9. The apparatus according to claim 8, wherein the coated paper includes low ignition propensity wrapping paper for cigarettes, obtained by applying a fire retardant to the web.

10. The apparatus according to claim 7, wherein the coated paper includes low ignition propensity wrapping paper for cigarettes, obtained by applying a fire retardant to the web.

11. The apparatus according to claim 7, wherein:

the coater includes a coating device having a gravure roller configured to apply the coating liquid, the gravure roller has an engraved coating region for applying the coating liquid and an unengraved non-coating region alternating with the coating region in a rotating direction of the gravure roller, and the coating band pitch determined by the coating region and the non-coating region is made narrower than the design band pitch by reducing a dimension of the non-coating region.

12. The apparatus according to claim 11, wherein the coated paper includes low ignition propensity wrapping paper for cigarettes, obtained by applying a fire retardant to the web.

* * * * *